US005454133A

United States Patent [19]

Garnet

[11] Patent Number: 5,454,133

[45] Date of Patent: Oct. 3, 1995

[54] TOOTHBRUSH

[76] Inventor: Arrow Garnet, 856 Upper James #20293, Hamilton, Ontario, Canada, L9C-7M8

[21] Appl. No.: 144,401

[22] Filed: Nov. 2, 1993

[51] Int. Cl.[6] ..... A46B 9/04; A46B 9/08

[52] U.S. Cl. ..... 15/106; 15/167.1; 15/176.2; 15/194; 15/201; 15/207.2; 132/309

[58] Field of Search ..... 15/106, 110, 143.1, 15/167.1, 167.2, 176.2, 191.1, 192, 193, 201, 202, 194; 132/207.2, 309

[56] References Cited

U.S. PATENT DOCUMENTS

| | | | |
|---|---|---|---|
| 759,490 | 5/1904 | Yates | 15/143.1 |
| 1,148,566 | 8/1915 | Barry | 15/192 |
| 1,323,042 | 11/1919 | Gardner | 15/167.1 |
| 2,141,969 | 12/1938 | Benz | 15/167.1 |
| 2,164,219 | 6/1939 | McGerry | 15/167.1 |
| 2,819,482 | 1/1958 | Applegate | 15/106 |
| 2,882,544 | 4/1959 | Hadidian | 15/201 |
| 2,935,755 | 5/1960 | Leira | 15/167.1 |
| 3,082,457 | 3/1963 | Lucibello | 15/167.1 |
| 3,129,449 | 4/1964 | Cyzer | 15/167.1 |
| 4,240,452 | 12/1980 | Jean | 15/201 |
| 4,462,136 | 7/1984 | Nakao | 15/110 |
| 4,520,526 | 6/1985 | Peters | 15/167 |
| 4,633,542 | 1/1987 | Taravel | 15/201 |
| 4,694,844 | 9/1987 | Berl | 15/201 |
| 4,731,896 | 3/1988 | de la Tour | 15/110 |
| 4,829,621 | 5/1989 | Phenegar | 15/167.1 |
| 5,052,071 | 10/1991 | Halm | 15/167.1 |
| 5,054,154 | 10/1991 | Schiffer et al. | 15/167.1 |

FOREIGN PATENT DOCUMENTS

| | | | |
|---|---|---|---|
| 0711331 | 9/1944 | Germany | 15/143.1 |
| 0304459 | 1/1929 | United Kingdom | 15/143.1 |
| 8801480 | 3/1988 | WIPO | 15/167.1 |

*Primary Examiner*—David A. Scherbel
*Assistant Examiner*—Randall E. Chin
*Attorney, Agent, or Firm*—Richard L. Miller

[57] ABSTRACT

A toothbrush, comprising a handle, having a head portion and a grip portion. The head portion has a plurality of bristle cavities, each for receiving a bristle group. The bristle cavities are connected with passage ways. The bristle groups are mounted in the bristle cavities with a rubber base, creating a seal with its associated bristle cavity, creating a closed system where the bristle cavities are in fluid communication with each other through the passage ways. The closed system is filled with a substantially non-compressible medium. When pressure is exerted on one bristle group, pressure is thereby exerted on the medium, which exerts pressure on the other bristle groups, in turn applying even pressure to all bristle groups. A plaque remover, having a fiberglass pick, is mounted in the grip portion of the handle.

9 Claims, 1 Drawing Sheet

TOOTHBRUSH

BACKGROUND OF THE INVENTION

The invention relates to a toothbrush. More specifically, the invention relates to a toothbrush having a networked bristle arrangement.

U.S. Pat. No. 4,520,526 to Peters, discloses a toothbrush having a flexible portion, for altering the angle of the toothbrush head.

U.S. Pat. No. 5,052,071 to Halm, discloses a toothbrush having a plurality of V-shaped folds in the handle, for facilitating a bend in the handle.

U.S. Pat. No. 5,054,154 to Schiffer et al., discloses a toothbrush having an elastic segment between the handle and bristle head.

While these units may be suitable for the particular purpose employed, or for general use, they would not be as suitable for the purposes of the present invention as hereafter described.

SUMMARY OF THE INVENTION

It is an object of the invention to produce a toothbrush that is effective in cleaning teeth.

It is another object to produce a toothbrush that is angled, to facilitate proper cleaning of hard to reach tooth surfaces.

It is a further object of the invention to produce a toothbrush that exerts even pressure on its working surface.

It is a still further object of the invention to provide a toothbrush that has provisions for effectively removing plaque and food particles from spaces between teeth.

The invention is a toothbrush, comprising a handle, having a head portion and a grip portion. The head portion has a plurality of bristle cavities, each for receiving a bristle group. The bristle cavities are connected with passage ways. The bristle groups are mounted in the bristle cavities with a rubber base, creating a seal with its associated bristle cavity, creating a closed system where the bristle cavities are in fluid communication with each other through the passage ways. The closed system is filled with a substantially non-compressible medium. When pressure is exerted on one bristle group, pressure is thereby exerted on the medium, which exerts pressure on the other bristle groups, in turn applying even pressure to all bristle groups. A plaque remover, having a fiberglass pick, is mounted in the grip portion of the handle.

BRIEF DESCRIPTION OF THE DRAWINGS

In the drawings, like elements are depicted by like reference numerals throughout the several views. The drawings are briefly described below.

DETAILED DESCRIPTION OF THE PREFERRED EMBODIMENTS

Figure 1:
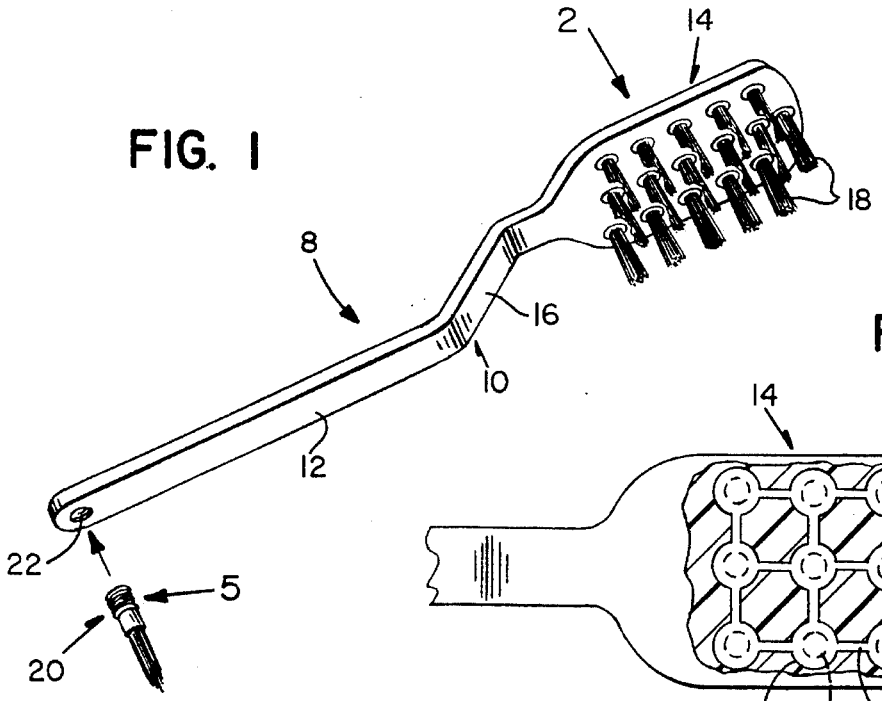
FIG. 1 is a diagrammatic perspective view of the instant invention.

FIG. 1 is a perspective view of the toothbrush of the instant invention. The toothbrush 8 has a handle 10. The handle has a grip portion 12, a head portion 14, and has a flexible bridge portion 16 between the grip portion 12 and head portion 14. The bridge portion 16 is attached to the grip portion 12 at an angle, and to the head portion 14 at a supplementary angle, thereby recessing the head portion 14, but maintaining a parallel relationship between the grip portion 12 and the head portion 14.

The flexible bridge portion 16 may be made out of a separate component which is secured between the head portion 14 and the handle 10, or alternatively formed integrally out of the same material but designed in such a manner so as to have desirable flexible properties while still being sufficiently strong so as not to snap or fracture under ordinary wear and tear of every day tooth brushing conditions.

Bristle groups 18 are arranged in rows, and are mounted to the head portion 14.

A plaque remover 20, is mounted in a plaque remover bore 22 in the grip portion 12, at an end of the handle 10 opposite the head portion 14.

Figure 2:
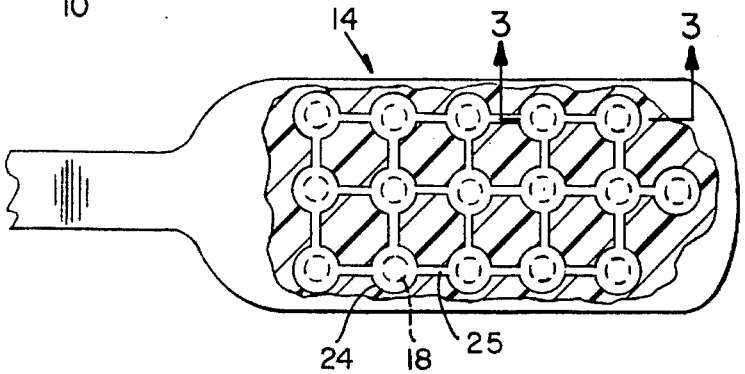
FIG. 2 is an enlarged view with parts broken away, taken in the direction of arrow 2 in FIG. 1.

FIG. 2 is a detail of the head portion 14. Each bristle group 18, shown in phantom, is supported in a bristle cavity 24. The bristle cavities are at orthogonally displaced locations forming a matrix and are connected by passage ways 25.

Figure 3:
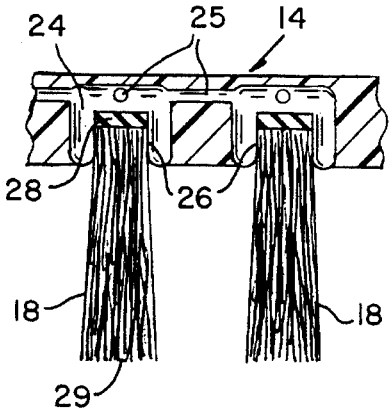
FIG. 3 is a further enlarged cross sectional view of a first embodiment with parts broken away, taken on line 3—3 in FIG 2.

FIG. 3 is an enlarged cross sectional view, illustrating the bristle cavities 24, and the passage ways 25 that interconnect them. Each bristle group 18 is submerged into the head portion 14, in a bristle group shaftway 26. The bristle group 18 has a rubber base 28 at the interface between the bristle group 18 and the bristle cavity 24. The bristle group 18 may be slightly embedded in the rubber base 28 or otherwise adhered thereto by well known techniques. Opposite the rubber base 28, the bristle group 18 has a bristle group upper surface 29, which contacts a Working surface, typically the surface of a tooth.

The rubber base 28 seals the bristle cavity 24, so that a closed system is created between the bristle cavities 24, the passage ways 25, and the rubber bases 28. The closed system is preferably filled with a substantially non-compressible pressure transmitting medium, such as a compressed gas, liquid or gel.

When pressure is applied to one bristle group 18, its rubber base 28 will compress, compressing the medium. The medium then exerts pressure on other rubber bases 28, causing them to expand, applying pressure on their associated bristle groups 18. Since all bristle cavities are in fluid communication with one another, even pressure is applied to each of the bristle groups 18. In turn, even pressure is applied by the bristle group upper surface 29, of each of the bristle groups 18, to the working surface. This allows for an even brushing action over the uneven terrain of a persons teeth, especially when cooperating with the flexible bridge portion 16 incorporated in the construction of handle 10. The bridge portion is made of a flexible metal blade or spring coil or a rubber piece.

Figure 4:
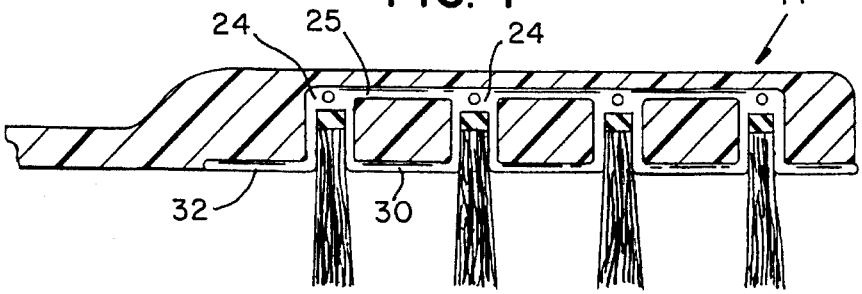
FIG. 4 is an enlarged cross sectional view of a second embodiment of the instant invention.

In a second embodiment, shown in FIG. 4, an upper passage way 30 connects the bristle cavities 24 near an upper surface 32 of the head portion 14. The upper passage way 30 is part of the closed system, and supplements the fluid communication between the bristle cavities 24 provided by the passage ways 25 alone in the first embodiment.

Figure 5:
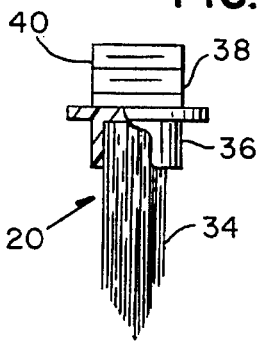
FIG. 5 is a side elevational view, partially in section, taken in the direction of arrow 5 in FIG. 1, of just a plaque remover component of the instant invention per se.

A detail of the plaque remover 20 is shown in FIG. 5. The plaque remover 20 has a pick 34, preferably made of a bundle of fiberglass bristles, mounted in a plaque remover base 36. The plaque remover base 36 has a flexible neck 38, made of rubber, to provide it with flexibility. The plaque remove base 36 is terminated on an end opposite the pick 34 with a threaded portion 40. The threaded portion 40 is adapted to screw into the plaque remover bore 22, which has matching thread. Alternatively the base could be mounted in non-threaded bore 22 by force fit of an appropriately sized non-threaded portion 40.

What is claimed is:

1. A toothbrush comprising:

a) a handle forming a grip portion and connected to a head portion;

b) a series of groups of elongated bristles, each group having a lower end mounted on a respective rubber base;

c) a series of bristle cavities formed in the head portion at orthogonally displaced locations forming a matrix, and having respective shaftways, each shaftway receiving the rubber base of an associated bristle group thereby creating a seal with the bristle cavity, and the bristle cavities all being connected to one another by passageways creating a closed system the closed system having a substantially non-compressible, pressure transmitting medium, selected from a gel medium, a liquid medium and a gas medium filling the closed system.

2. The toothbrush as recited in claim 1, wherein the head portion has an upper surface, and the passageways connect each adjacent bristle cavities at locations both adjacent and remote from the upper surface.

3. The apparatus as recited in claim 2, further comprising a plaque remover, mounted in the grip portion of the handle, the plaque remover having a pick.

4. The apparatus as recited in claim 3, wherein the pick is made of a bundle of fiberglass bristles.

5. The apparatus as recited in claim 4, wherein the plaque remover further comprises a plaque remover base, a threaded portion, and a flexible portion between the plaque remover base and the threaded portion.

6. The apparatus as recited in claim 1, further comprising a plaque remover, mounted in the grip portion of the handle, the plaque remover having a pick.

7. The apparatus as recited in claim 2, wherein the pick is made of a bundle of fiberglass bristles.

8. The apparatus as recited in claim 7, wherein the plaque remover further comprises a plaque remover base, a threaded portion, and a flexible portion between the plaque remover base and the threaded portion.

9. The apparatus as recited in claim 1 further comprising a flexible bridge portion between the grip portion and head portion, the bridge portion forming an angle with the grip portion and a supplementary angle with the head portion, so that the head portion is at a lower level than but parallel to the grip portion.

* * * * *